US009481934B2

(12) United States Patent
Kamioka

(10) Patent No.: US 9,481,934 B2
(45) Date of Patent: Nov. 1, 2016

(54) METHOD OF REMOVING WORK-AFFECTED LAYER

(71) Applicant: MITSUBISHI HEAVY INDUSTRIES, LTD., Tokyo (JP)

(72) Inventor: Taisuke Kamioka, Tokyo (JP)

(73) Assignee: MITSUBISHI HEAVY INDUSTRIES AERO ENGINES, LTD., Aichi (JP)

( * ) Notice: Subject to any disclaimer, the term of this patent is extended or adjusted under 35 U.S.C. 154(b) by 0 days.

(21) Appl. No.: 13/796,150

(22) Filed: Mar. 12, 2013

(65) Prior Publication Data

US 2013/0299456 A1 Nov. 14, 2013

(30) Foreign Application Priority Data

May 9, 2012 (JP) ..... 2012-107713

(51) Int. Cl.
*C25F 3/00* (2006.01)
*C23F 1/20* (2006.01)
(Continued)

(52) U.S. Cl.
CPC . *C23F 1/20* (2013.01); *C23F 1/16* (2013.01); *C23F 1/26* (2013.01); *C23F 3/06* (2013.01); *C23G 1/106* (2013.01)

(58) Field of Classification Search
CPC ..... C23F 3/06; C23F 1/04; C23F 1/14; C23F 1/26; C23G 1/106; C23G 1/00; C23G 1/02; C23G 1/125
USPC ..... 216/22, 24, 53, 34, 100–104; 252/79.1, 252/79.3; 148/237, 670; 416/204 A; 134/3
See application file for complete search history.

(56) References Cited

U.S. PATENT DOCUMENTS 2,876,144 A * 3/1959 Bomberger et al. ..... 134/3
2,974,021 A 3/1961 Borowik
(Continued)

FOREIGN PATENT DOCUMENTS

EP 1 477 141 11/2004
EP 2 143 823 1/2010
(Continued)

OTHER PUBLICATIONS

Extended European Search Report issued Aug. 27, 2013 in European patent application No. 13159390.
(Continued)

*Primary Examiner* — Nadine Norton
*Assistant Examiner* — Christopher Remavege
(74) *Attorney, Agent, or Firm* — Wenderoth, Lind & Ponack, L.L.P.

(57) ABSTRACT

A method of removing a work-affected layer formed on the worked surface of a TiAl-based alloy (base material) by machining work, without exerting any adverse effect on the base material. The method of removing the work-affected layer includes a step of dipping a TiAl-based alloy, having a work-affected layer formed on the surface thereof by machining, in an etchant containing predetermined concentrations of hydrofluoric acid and nitric acid. Within the etchant, the concentration of the hydrofluoric acid is not less than 5 g/L and not more than 56 g/L, and the concentration of the nitric acid is selected from within a range from not less than 50 g/L to not more than 260 g/L in accordance with a combination of the concentration of the hydrofluoric acid within the etchant and the etching treatment temperature.

2 Claims, 16 Drawing Sheets

(51) Int. Cl.

| | |
|---|---|
| ***C23F 1/16*** | (2006.01) |
| ***C23F 1/26*** | (2006.01) |
| ***C23F 3/06*** | (2006.01) |
| ***C23G 1/10*** | (2006.01) |

(56) References Cited

U.S. PATENT DOCUMENTS

| | | | | |
|---|---|---|---|---|
| 2,981,609 | A | 4/1961 | Acker et al. | |
| 2,981,610 | A | 4/1961 | Snyder et al. | |
| 3,666,580 | A | 5/1972 | Kreml et al. | |
| 3,753,815 | A * | 8/1973 | Burton et al. | 216/109 |
| 3,944,496 | A * | 3/1976 | Coggins et al. | 252/79.3 |
| 4,900,398 | A * | 2/1990 | Chen | 216/109 |
| 5,705,082 | A * | 1/1998 | Hinson | 216/95 |
| 6,232,573 | B1 * | 5/2001 | Fukai et al. | 219/121.14 |
| 2004/0265780 | A1 | 12/2004 | Robb et al. | |
| 2008/0169270 | A1 * | 7/2008 | Parkos et al. | 216/100 |
| 2009/0326674 | A1 | 12/2009 | Liu et al. | |
| 2012/0074098 | A1 | 3/2012 | Filho et al. | |
| 2012/0288828 | A1 | 11/2012 | Robb et al. | |
| 2013/0126474 | A1 * | 5/2013 | Shi et al. | 216/53 |

FOREIGN PATENT DOCUMENTS

| | | |
|---|---|---|
| FR | 2 961 598 | 12/2011 |
| JP | 6-269927 | 9/1994 |

OTHER PUBLICATIONS

A. Bloyce et al., "Surface Engineering of Titanium and Titanium Alloys" ASM Handbook, vol. 5: Surface Engineering, pp. 835-852, 1994.

Communication under Rule 71(3) EPC was issued Nov. 24, 2014 in corresponding European patent application No. 13159390.7.

Notice of Allowance issued Sep. 11, 2014 in corresponding Canadian patent application No. 2809079.

A Decision to Grant a Patent issued Apr. 23, 2015 in corresponding European Patent Application No. 13159390.7.

* cited by examiner

×500

×500

METHOD OF REMOVING WORK-AFFECTED LAYER

TECHNICAL FIELD

The present invention relates to a method of removing a work-affected layer, and relates particularly to a method of removing a work-effected layer formed on the surface of a TiAl-based alloy by machining work.

BACKGROUND ART

Conventionally, Ni-based alloys have been used as the base material for aircraft engine blades, but in recent years, the use of TiAl-based alloys, which exhibit high specific strength, has become possible.

However, as disclosed in Patent Citation 1, TiAl-based alloys exhibit poor formability, and are difficult to cut. Further, TiAl-based alloys are more brittle than Ni-based alloys, and tend to be prone to the generation of a work-affected layer on the worked surface when machining work such as cutting or grinding is performed.

A work-affected layer has increased hardness compared with the base material, and therefore the surface of a TiAl-based alloy with a work-affected layer formed thereon tends to be prone to cracking.

CITATION LIST

Patent Literature

Patent Citation 1: Japanese Unexamined Patent Application, Publication No. Hei 6-269927 (paragraph [0003])

DISCLOSURE OF INVENTION

Technical Problem

Consideration is now being given to machining conditions that do not result in the formation of a work-affected layer, but with current technology, performing machining work with absolutely no formation of a work-affected layer is difficult. Further, no technique has been developed for efficiently removing a work-affected layer formed on the surface of a TiAl-based alloy.

In those cases where a work-affected layer is formed on the surface of a TiAl-based alloy, a method of removing the work-affected layer by dipping the alloy in an etchant may be used. However, when a TiAl-based alloy is dipped in an etchant, defects such as large erosion holes and fissures that have an adverse effect on the base material tend to be generated.

The present invention has been developed in light of these circumstances, and has an object of providing a method of removing a work-affected layer formed on the worked surface of a TiAl-based alloy (base material) by machining work, without exerting any adverse effect on the base material.

Solution to Problem

In order to achieve the above object, the present invention provides a method of removing a work-affected layer, the method including a step of dipping a TiAl-based alloy having a work-affected layer formed on the surface thereof by machining work in an etchant containing predetermined concentrations of hydrofluoric acid and nitric acid, wherein within the etchant, the concentration of the hydrofluoric acid is not less than 5 g/L and not more than 56 g/L, and the concentration of the nitric acid is selected from within a range from not less than 50 g/L to not more than 260 g/L in accordance with a combination of the concentration of the hydrofluoric acid within the etchant and the etching treatment temperature.

Within the work-affected layer, the grains have moved and been compressed, meaning the grain boundaries are closer together. As a result, etching that originates at the grain boundaries tends to occur readily. In the present invention, by using an etchant that contains hydrofluoric acid and nitric acid in a predetermined ratio, the occurrence of surface defects such as large erosion holes and fissures that have an adverse effect on the base material can be suppressed, while the work-affected layer is preferentially removed.

In one aspect of the invention described above, it is preferable that phosphoric acid is also added to the etchant. By employing this aspect, the surface of the base material following the etching treatment is able to be provided with a smoother finish.

Effects of Invention

According to the present invention, a work-affected layer can be removed effectively without damaging the base material.

BEST MODE FOR CARRYING OUT THE INVENTION

Figure 1:
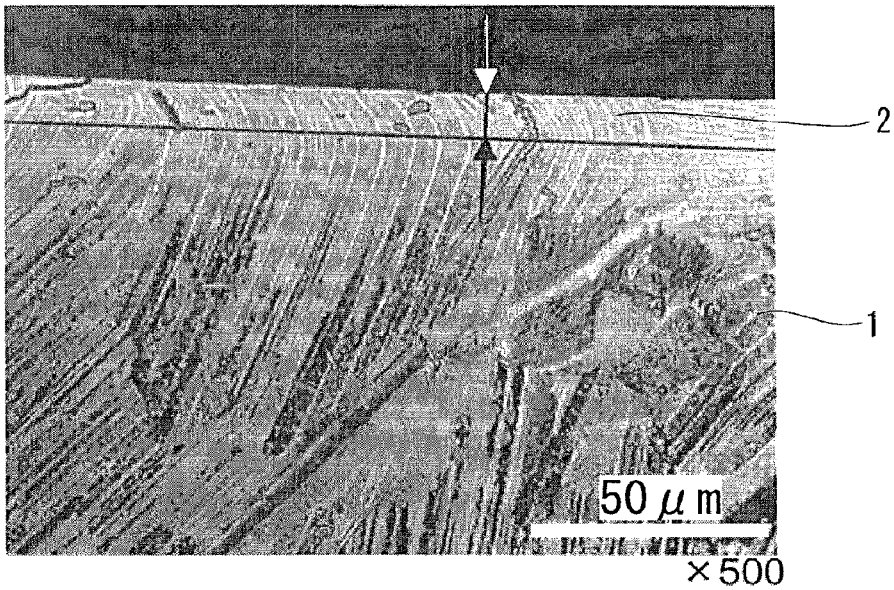
FIG. 1 A cross-sectional photograph of a base material that has been cut according to an example.

The method of removing a work-affected layer according to the present invention is applied to aircraft engine components such as engine turbines.

An embodiment of the method of removing a work-affected layer according to the present invention is described below with reference to the drawings.

First Embodiment

In the present embodiment, a base material having a work-affected layer formed on the surface as a result of machining work such as cutting or grinding is dipped in an etchant, thereby removing the work-affected layer formed on the surface.

The base material is a TiAl-based alloy having a full lamellar structure. The thickness of the work-affected layer is approximately 5 μm to 20 μm.

The base material with the work-affected layer formed thereon is subjected to an appropriate pretreatment such as ultrasonic cleaning or alkali cleaning prior to dipping in the etchant.

The etchant is formed as an aqueous solution containing predetermined proportions of hydrofluoric acid (HF) and nitric acid ($HNO_3$). The hydrofluoric acid concentration within the etchant is not less than 5 g/L and not more than 56 g/L. The nitric acid concentration within the etchant is selected from within a range from not less than 50 g/L to not more than 260 g/L in accordance with a combination of the hydrofluoric acid concentration within the etchant and the temperature of the etchant during the etching treatment.

The temperature of the etchant is preferably within a range from 20° C. to 40° C. The etching rate is preferably within a range from 1 μm/minute to 15 μm/minute.

The etchant may include other components that are typically contained within the reagents marketed commercially as hydrofluoric acid and nitric acid.

Further, the etchant may also contain phosphoric acid.

The amount of nitric acid in the etchant is typically 4 times to 45 times (by weight) the amount of hydrofluoric acid.

For example, when the etchant temperature is set to 35° C., the amount of nitric acid in the etchant is typically 4 times to 45 times (by weight), preferably 4.5 times to 22.5 times (by weight), and more preferably 4.5 times to 9 times (by weight), the amount of hydrofluoric acid.

For example, when the etchant temperature is set to 50° C., the amount of nitric acid in the etchant is typically 4.5 times to 45 times (by weight), preferably 4.5 times to 22.5 times (by weight), and more preferably 9 times to 22.5 times (by weight), the amount of hydrofluoric acid. However, if a ratio of 4.5 times (by weight) is used, then the hydrofluoric acid concentration within the etchant is preferably higher than 28 g/L.

For example, when the etchant temperature is set to 65° C., the amount of nitric acid in the etchant is typically 4.5 times to 45 times (by weight), and preferably 9 times to 45 times (by weight) the amount of hydrofluoric acid.

By using concentrations that satisfy the above ranges, a base material can be obtained for which, even following etching treatment, the depth of the largest pit (erosion hole) in the base material surface is not more than 10 μm, and the surface is free of fissures (steep cracks) caused by the etching treatment.

The time for which the base material having the work-affected layer formed thereon is dipped in the etchant may be selected appropriately in accordance with the thickness of the work-affected layer. The thickness of the work-affected layer varies depending on the machining conditions employed during the machining work. Accordingly, a preliminary test may be performed to ascertain the thickness of the work-affected layer that is formed when machining is performed under predetermined machining conditions, with the etching treatment time then determined on the basis of the etching rate of the etchant being used and the thickness of the work-affected layer.

Following dipping in the etchant, the base material may be subjected to appropriate post-treatments such as neutralization, water washing and drying.

EXAMPLES

1. Preparation of Test Pieces

A TiAl-based alloy containing mainly Ti-45Al was used as the base material, and this base material was subjected to cutting to prepare test pieces. A grinding process was used to achieve the cutting.

FIG. 1 is a cross-sectional photograph (×500) of a base material that has been cut under the conditions described above. FIG. 1 reveals the formation of a work-affected layer 2 having a thickness of 12 μm at the machined surface of a base material 1. The orientation of the structure of the work-affected layer 2 differs from the orientation of the structure in the base material 1, and it is evident that the cutting was performed in a direction from the right side of the figure towards the left side.

Figure 2:
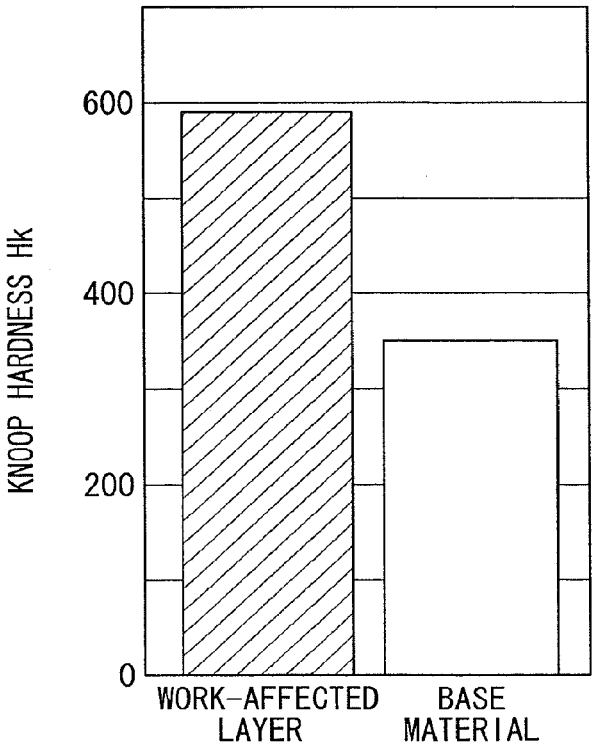
FIG. 2 A diagram illustrating the hardness distribution of a work-affected layer and a base material.

FIG. 2 illustrates the hardness distribution for the work-affected layer and the base material. The work-affected layer 2 has a hardness that is at least 1.5 times higher than that of the base material 1.

2. Preliminary Selection of Etchant

Etchant A: Nitric acid (purchased product, concentration: 61%) and hydrofluoric acid (purchased product, concentration: 47%) were mixed together in a ratio (by volume) of 14:1.

Etchant B: Nitric acid, hydrofluoric acid and distilled water were mixed together to achieve final concentration levels of 185 g/L of nitric acid and 13 g/L of hydrofluoric acid.

Etchant C: Nitric acid, hydrochloric acid, iron chloride and distilled water were mixed together to achieve final concentration levels of 16 g/L of nitric acid, 295 g/L of hydrochloric acid and 160 g/L of iron chloride.

Figure 3:
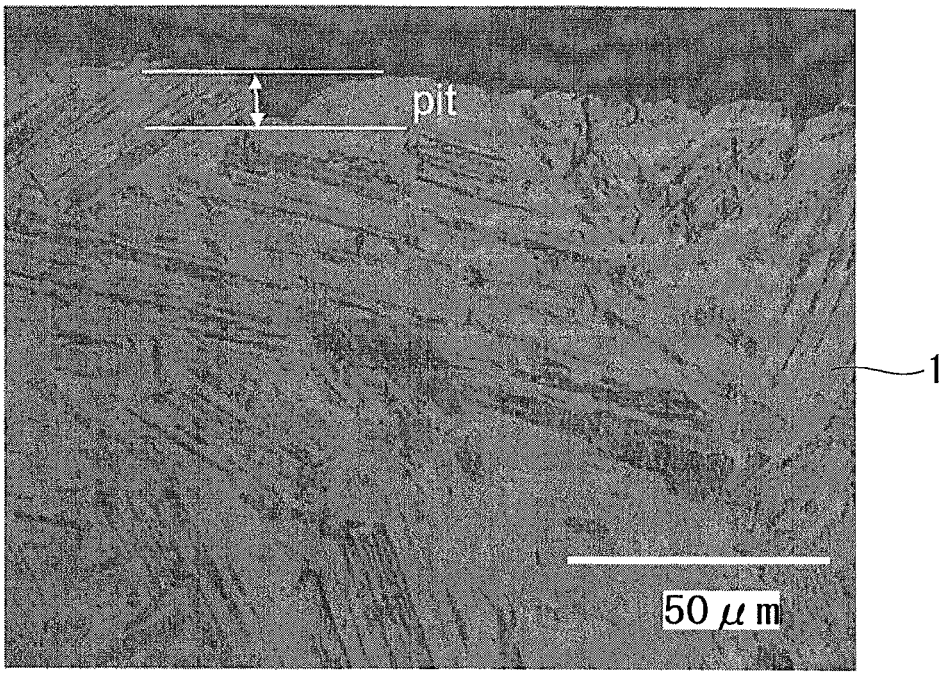
FIG. 3 A cross-sectional photograph of a test piece following etching treatment in an etchant A.
Figure 4:
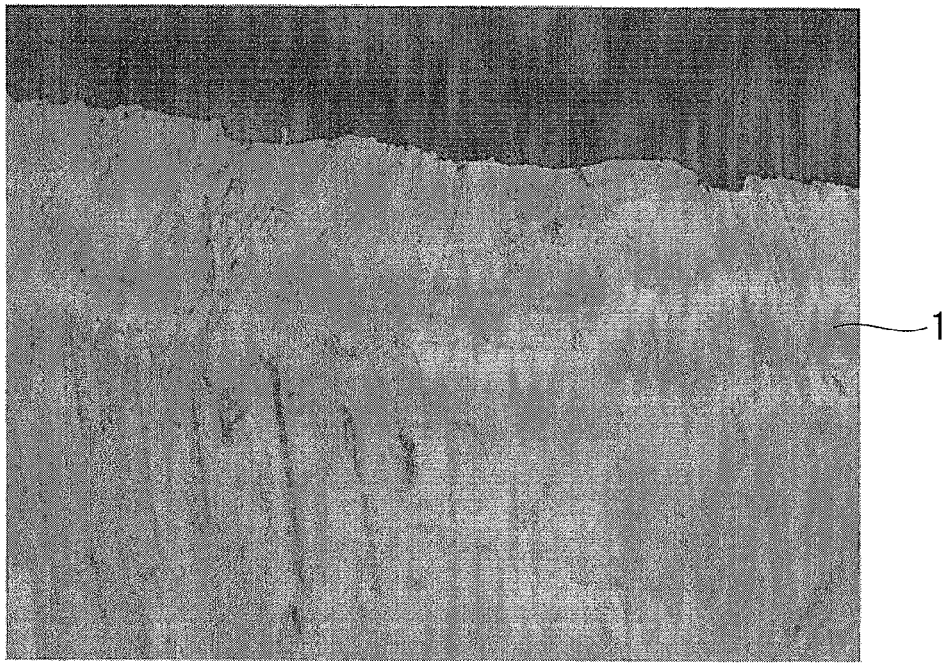
FIG. 4 A cross-sectional photograph of a test piece following etching treatment in an etchant B.
Figure 5:
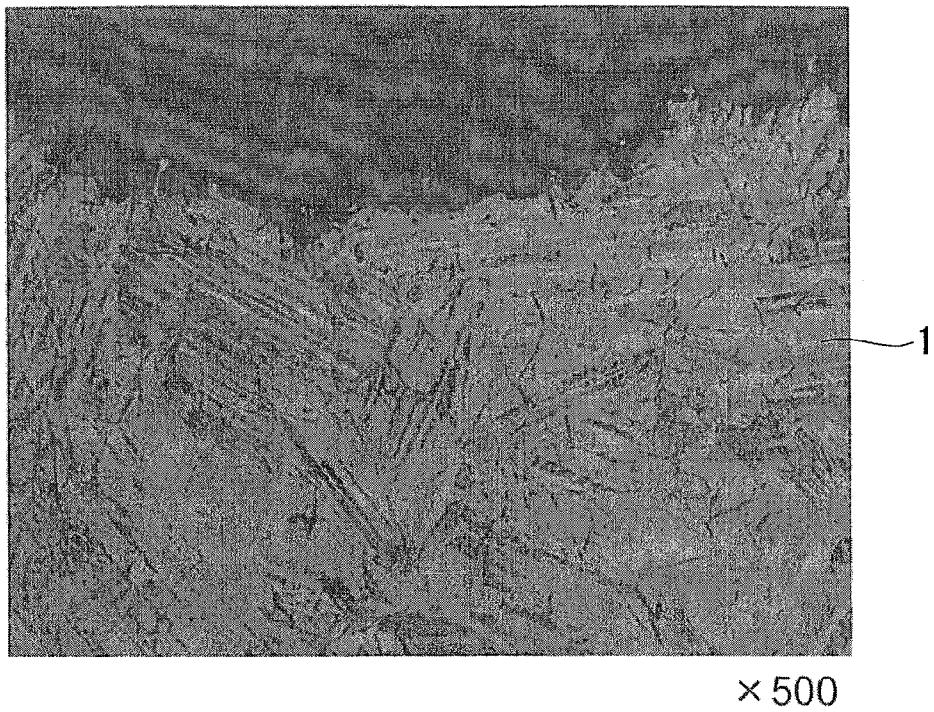
FIG. 5 A cross-sectional photograph of a test piece following etching treatment in an etchant C.

The test pieces described above were subjected to ultrasonic cleaning and a degreasing treatment (acetone cleaning), and a test piece was then dipped in each of the etchants A to C for 10 minutes or 30 minutes. The temperature of the etchant A was 51° C. The temperature of the etchant B and the etchant C was 24° C. Subsequently, each test piece was cut, and the cross-section was inspected under an optical microscope (×500). FIG. 3 to FIG. 5 are cross-sectional photographs of the test pieces following the different etching treatments. FIG. 3 illustrates the test piece that was dipped in the etchant A, FIG. 4 the test piece that was dipped in the etchant B, and FIG. 5 the test piece that was dipped in the etchant C.

Based on FIG. 3 to FIG. 5 it is evident that the test piece illustrated in FIG. 4 that was dipped in the etchant B had the smoothest surface with the least asperity. The same tendency was observed when the etching treatment time was set to 30 minutes. These results confirmed that the etchant B exhibited potential for etching the work-affected layer of a TiAl-based alloy.

TiAl-based alloys exhibit excellent corrosion resistance. This is because a passivation film is formed on the surface of the TiAl-based alloy. In order to remove a work-affected layer from a TiAl-based alloy by etching, this passivation film must first be destroyed. Passivation films are more readily destroyed in the presence of halide ions and the like. The fluoride ion contained within hydrofluoric acid is one type of halide ion. The effect of these fluoride ions causes destruction of the passivation film on the TiAl-based alloy. Accordingly, in the etchant B, it is thought that the passivation film was destroyed by the hydrofluoric acid, while the mixture containing the nitric acid caused subsequent gradual etching of the work-affected layer. On the other hand, in the case of the etchant A, although the etchant included the same components as the etchant B, similar effects were unobtainable. It is thought that this observation is due to the nitric acid concentration within the etchant A being too high.

3. Investigation of Etching Treatment Conditions

Based on the results of the preliminary tests described above, investigations were conducted into the effects of the concentrations of the hydrofluoric acid and nitric acid contained within the etchant, and the etching temperature.

Figure 6:
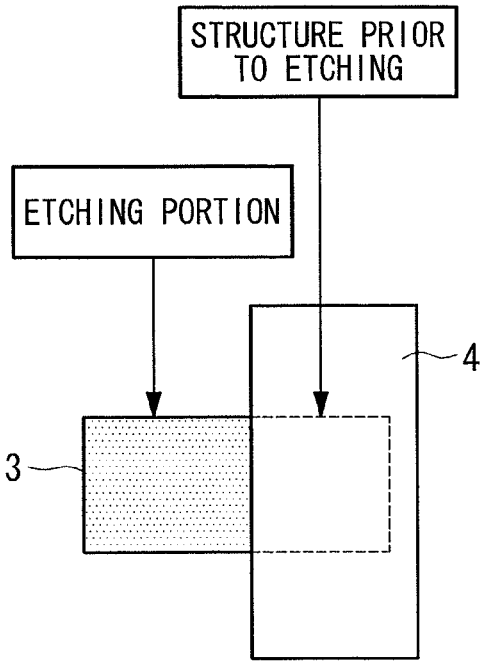
FIG. 6 A schematic diagram illustrating the masking of half of a test piece.
Figure 7:
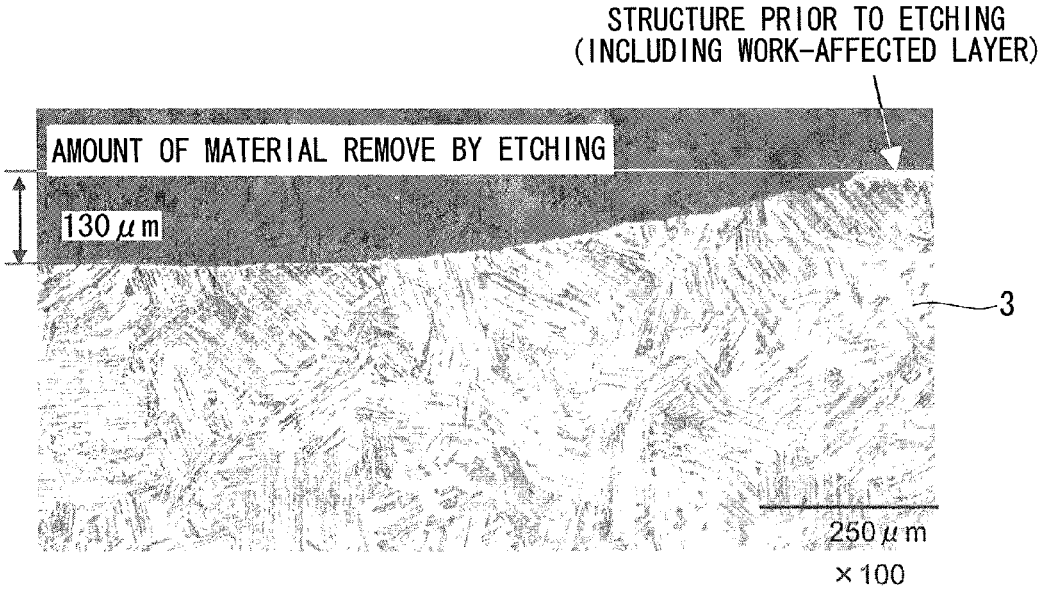
FIG. 7 A cross-sectional photograph of a test piece with the masking removed following an etching treatment.

The test pieces described above were subjected to ultrasonic cleaning and a degreasing treatment (alkali cleaning), half of each test piece 3 was then masked with an epoxy resin 4 in the manner shown in FIG. 6, and the test pieces were then dipped in a series of etchants having different concentrations of hydrofluoric acid and nitric acid (see Table 1) for 10 minutes or 30 minutes. The temperature of the etchant was set to 35° C., 50° C. or 65° C. Following the etching treatment, the epoxy resin 4 was removed from each test piece 3, and the test piece 3 was cut and inspected under an optical microscope (×100). From a cross-sectional photograph of the test piece, the height difference between the masked portion and the unmasked portion was measured, and the amount of material removed from the test piece by etching was measured (FIG. 7). A graph was prepared illustrating the relationship between the etching time and the amount of material removed by etching, and the etching rate was calculated from the slope of the graph.

Further, a test piece 3 described above was subjected to etching in the same manner as that described above without masking, and the test piece 3 was then cut and the cross-section was inspected under an optical microscope (×500). Furthermore, as comparative examples, test pieces described above were also dipped for 10 minutes or 30 minutes in an etchant (35° C.) composed of hydrofluoric acid 80 g/L, nitric acid 125 g/L and distilled water (the remainder).

Table 1 lists the concentrations of hydrofluoric acid and nitric acid within the etchants used when the etchant temperature was 35° C., and also lists the etching rates achieved.

TABLE 1

| Conditions | Hydrofluoric acid (g/L) | Nitric acid (g/L) | Etching rate (μm/min) |
|---|---|---|---|
| 1 | 5.6 | 252 | 1.6 |
| 2 | 56 | 252 | 8.4 |
| 3 | 5.6 | 0 | 0.9 |
| 4 | 28 | 126 | 3.4 |
| 5 | 56 | 126 | 7.3 |
| 6 | 28 | 0 | 3.2 |
| 7 | 28 | 252 | 6.2 |
| 8 | 10 | 80 | 3.1 |
| Comparative example | 80 | 125 | — |

The results in Table 1 showed that as the concentration of hydrofluoric acid within the etchant was increased, the etching rate also tended to increase.

Figure 8:
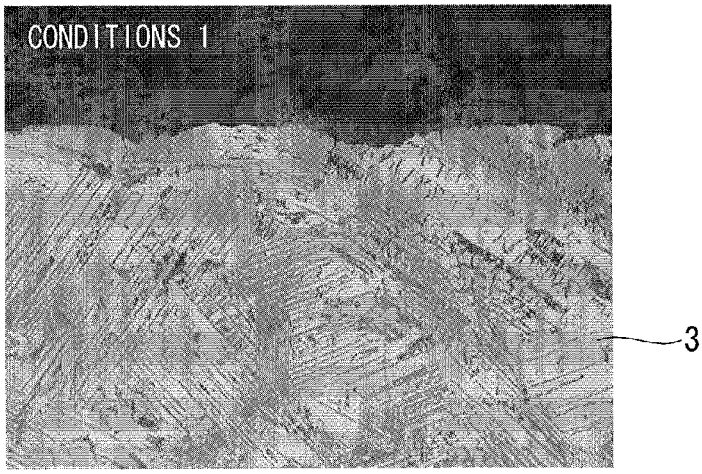
FIG. 8 A cross-sectional photograph of a test piece following dipping for 10 minutes in an etchant (35° C.) according to conditions 1.
Figure 9:
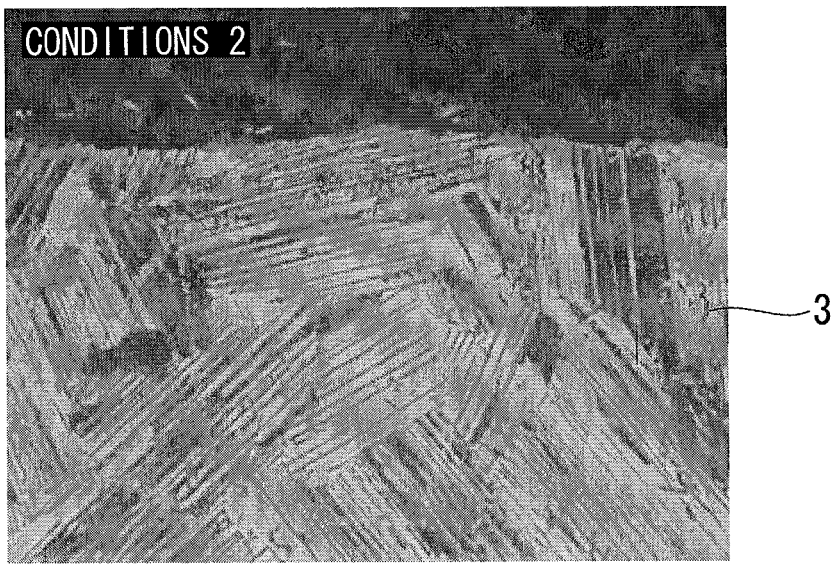
FIG. 9 A cross-sectional photograph of a test piece following dipping for 10 minutes in an etchant (35° C.) according to conditions 2.
Figure 10:
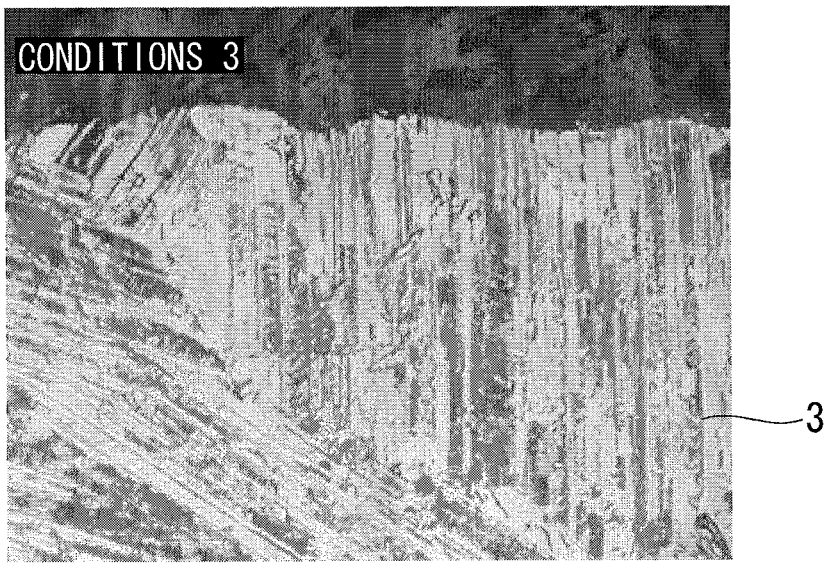
FIG. 10 A cross-sectional photograph of a test piece following dipping for 10 minutes in an etchant (35° C.) according to conditions 3.
Figure 11:
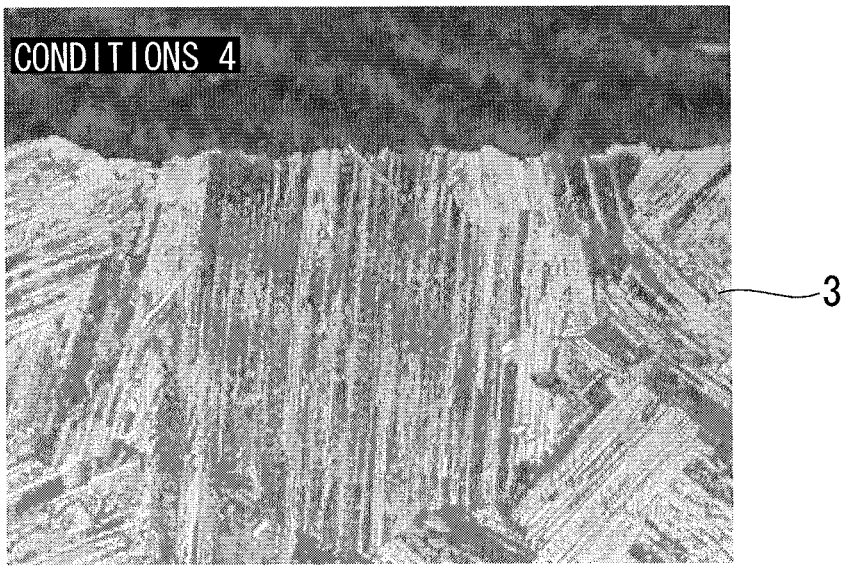
FIG. 11 A cross-sectional photograph of a test piece following dipping for 10 minutes in an etchant (35° C.) according to conditions 4.
Figure 12:
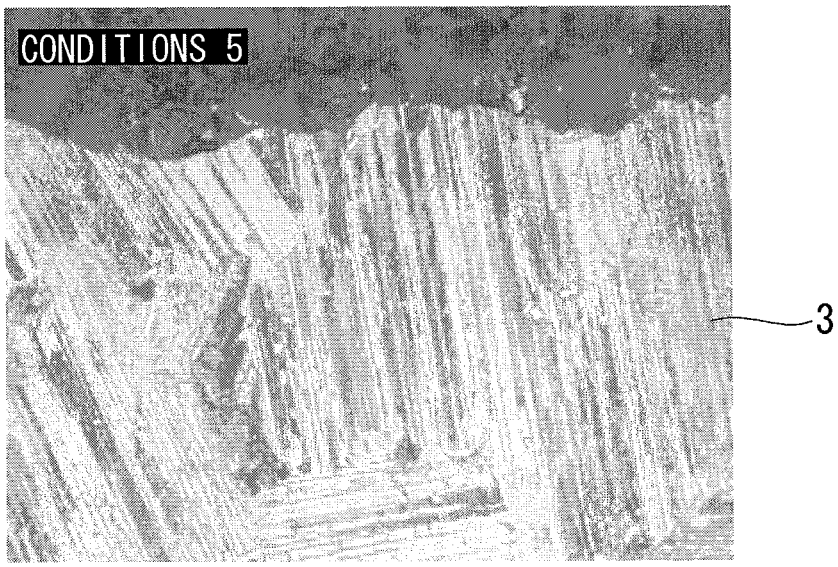
FIG. 12 A cross-sectional photograph of a test piece following dipping for 10 minutes in an etchant (35° C.) according to conditions 5.
Figure 13:
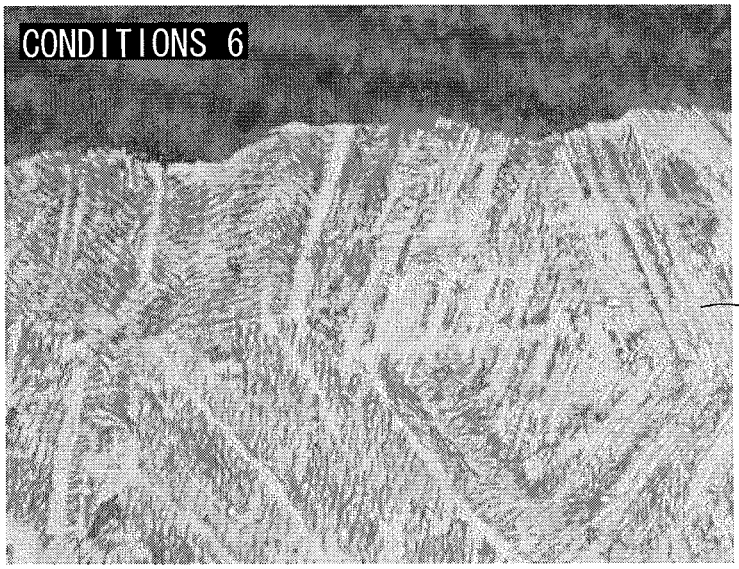
FIG. 13 A cross-sectional photograph of a test piece following dipping for 10 minutes in an etchant (35° C.) according to conditions 6.
Figure 14:
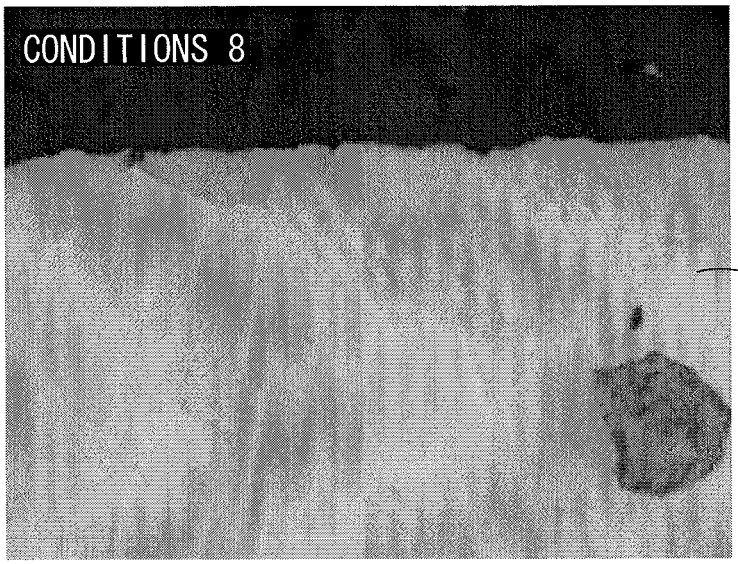
FIG. 14 A cross-sectional photograph of a test piece following dipping for 10 minutes in an etchant (35° C.) according to conditions 8.
Figure 15:
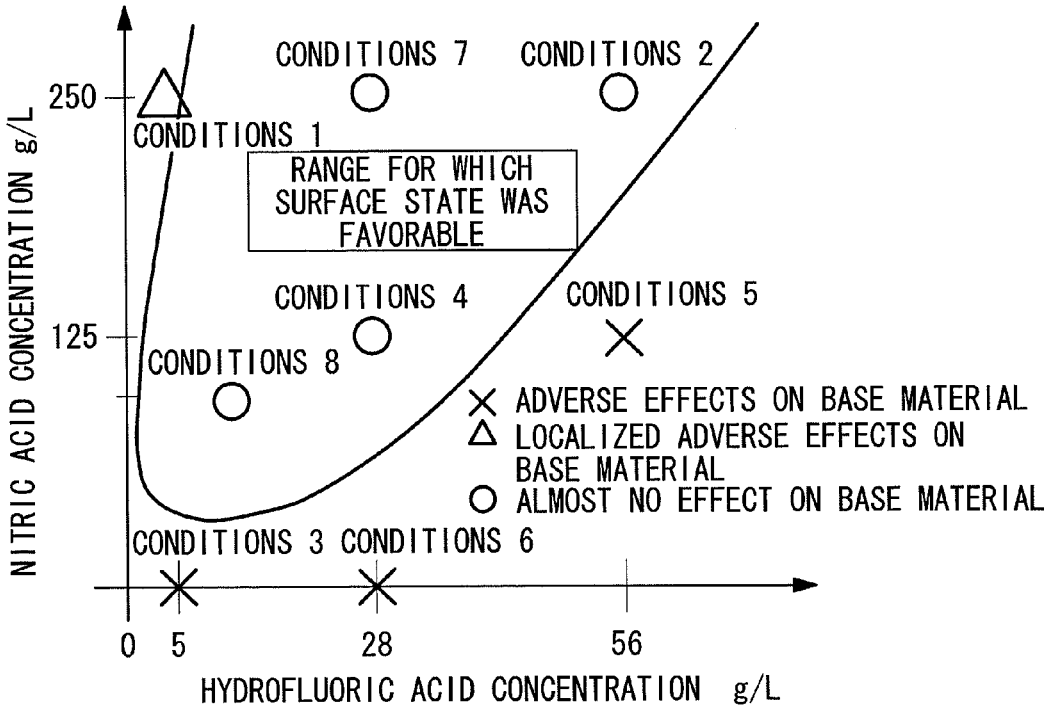
FIG. 15 A diagram illustrating the effect of the relationship between the hydrofluoric acid concentration and the nitric acid concentration on the structure following etching treatment (35° C.)

FIG. 8 to FIG. 14 are cross-sectional photographs of the test pieces following dipping for 10 minutes in each of the etchants (35° C.). FIG. 8 illustrates conditions 1, FIG. 9 illustrates conditions 2, FIG. 10 illustrates conditions 3, FIG. 11 illustrates conditions 4, FIG. 12 illustrates conditions 5, FIG. 13 illustrates conditions 6, and FIG. 14 illustrates conditions 8. FIG. 15 illustrates the effect of the relationship between the hydrofluoric acid concentration and the nitric acid concentration on the structure following the etching treatment (35° C.). In the figure, test pieces in which erosion holes (pits) or fissures exceeding 10 μm were observed were recorded using the symbol x, test pieces in which localized adverse effects were observed on the base material were recorded using the symbol Δ, and test pieces in which the surface state was favorable, namely test pieces in which no erosion holes (pits) or fissures exceeding 10 μm were observed, were recorded using the symbol ○. By satisfying the conditions that were deemed favorable, the strength required for the designated components can be achieved.

According to FIG. 8 to FIG. 14, erosion holes (pits) and/or fissures exceeding 10 μm were observed in the test pieces treated under the conditions 3, conditions 5 and conditions 6. On the other hand, under the conditions 1, localized adverse effects were observed on the base material. Furthermore, the surfaces of the test pieces treated under the conditions 2, conditions 4, conditions 7 and conditions 8 each exhibited a favorable state, and no erosion holes (pits) and/or fissures exceeding 10 μm were observed.

Figure 16:
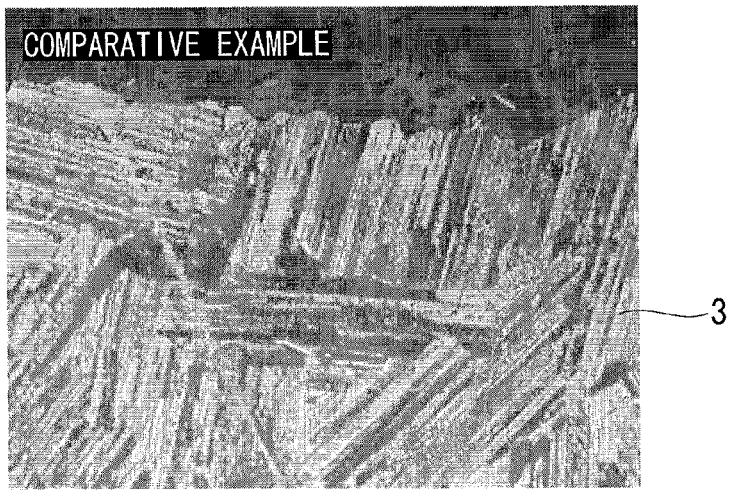
FIG. 16 A cross-sectional photograph of a test piece following dipping for 10 minutes in an etchant of a comparative example.

FIG. 16 is a cross-sectional photograph of a test piece following dipping for 10 minutes in the etchant of the comparative example. Erosion holes (pits) and fissures exceeding 10 μm composed of sharply angled irregularities were observed on the surface of the test piece.

Table 2 lists the concentrations of hydrofluoric acid and nitric acid within the etchants used when the etchant temperature was 50° C., and also lists the etching rates achieved.

TABLE 2

| Conditions | Hydrofluoric acid (g/L) | Nitric acid (g/L) | Etching rate (μm/min) |
|---|---|---|---|
| 9 | 28 | 126 | 8.9 |
| 10 | 5.6 | 126 | 3.1 |
| 11 | 28 | 252 | 6.6 |
| 12 | 56 | 0 | 10.8 |
| 13 | 5.6 | 0 | 1.1 |
| 14 | 56 | 252 | 14.7 |

Figure 17:
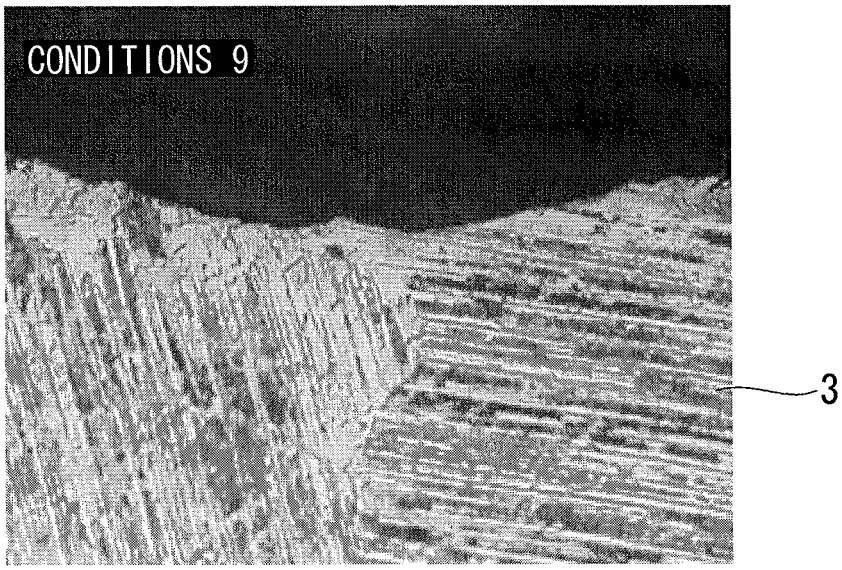
FIG. 17 A cross-sectional photograph of a test piece following dipping for 10 minutes in an etchant (50° C.) according to conditions 9.
Figure 18:
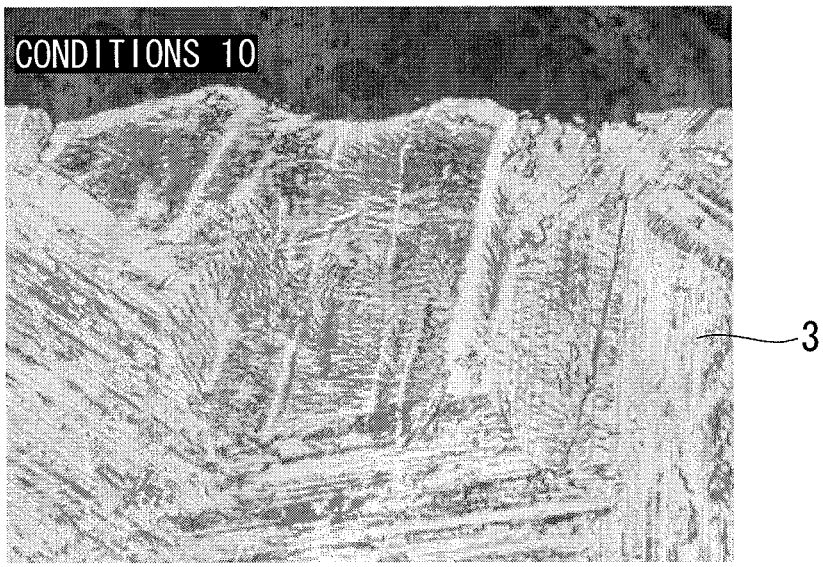
FIG. 18 A cross-sectional photograph of a test piece following dipping for 10 minutes in an etchant (50° C.) according to conditions 10.
Figure 19:
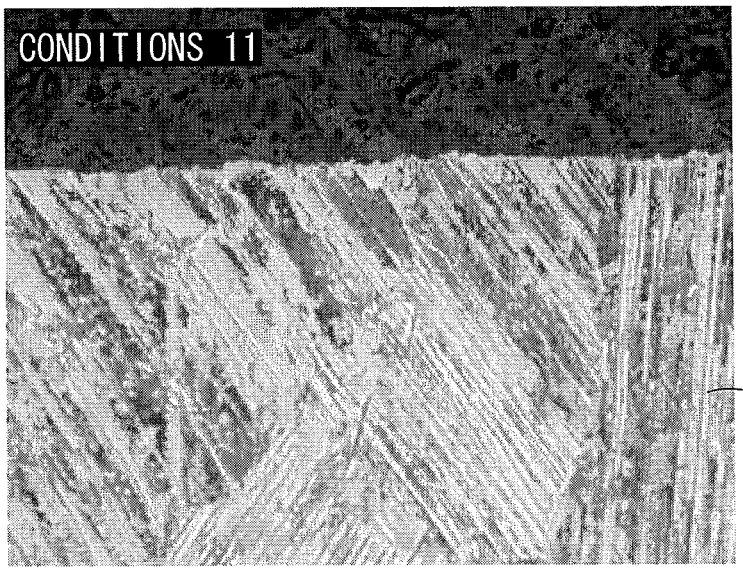
FIG. 19 A cross-sectional photograph of a test piece following dipping for 10 minutes in an etchant (50° C.) according to conditions 11.
Figure 20:
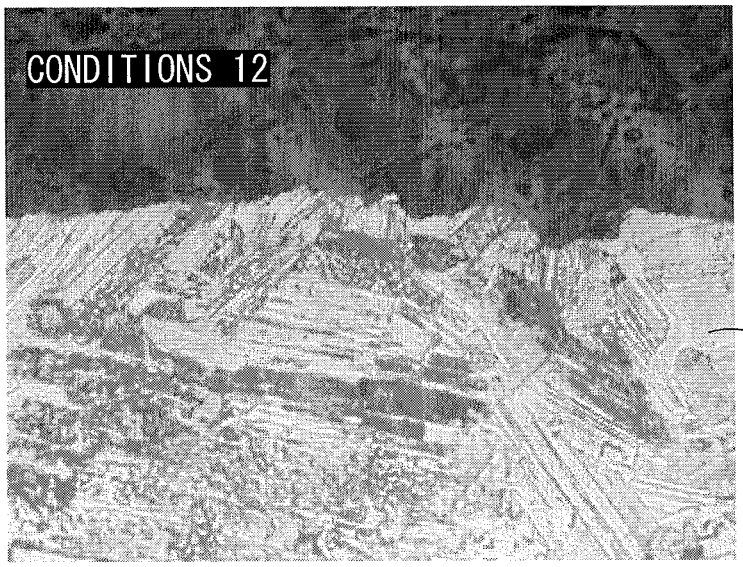
FIG. 20 A cross-sectional photograph of a test piece following dipping for 10 minutes in an etchant (50° C.) according to conditions 12.
Figure 21:
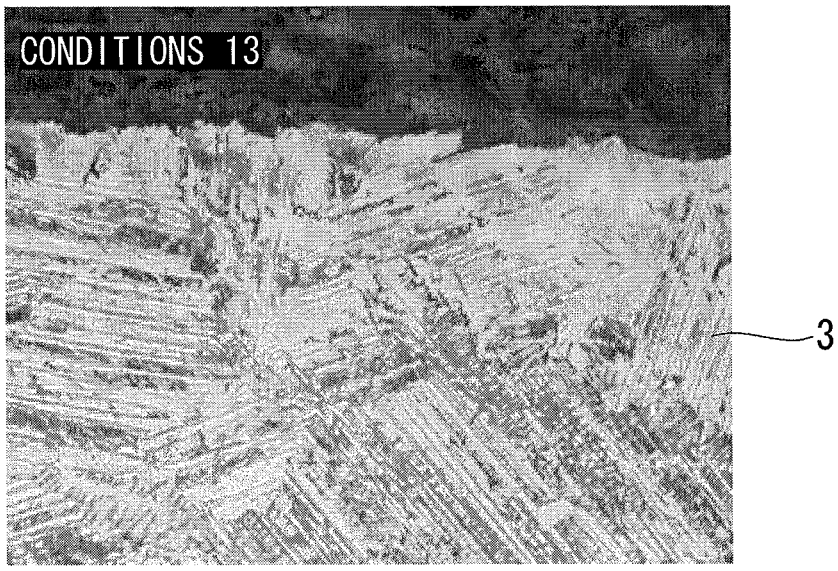
FIG. 21 A cross-sectional photograph of a test piece following dipping for 10 minutes in an etchant (50° C.) according to conditions 13.
Figure 22:
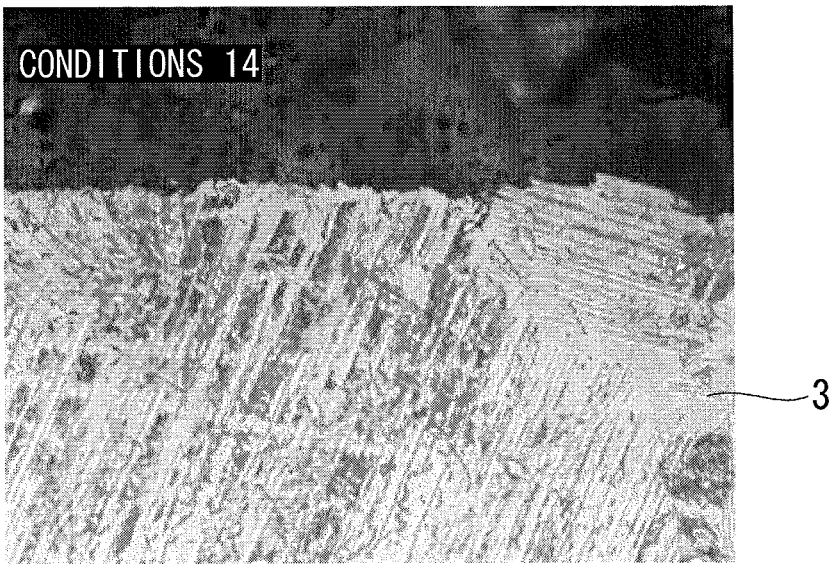
FIG. 22 A cross-sectional photograph of a test piece following dipping for 10 minutes in an etchant (50° C.) according to conditions 14.
Figure 23:
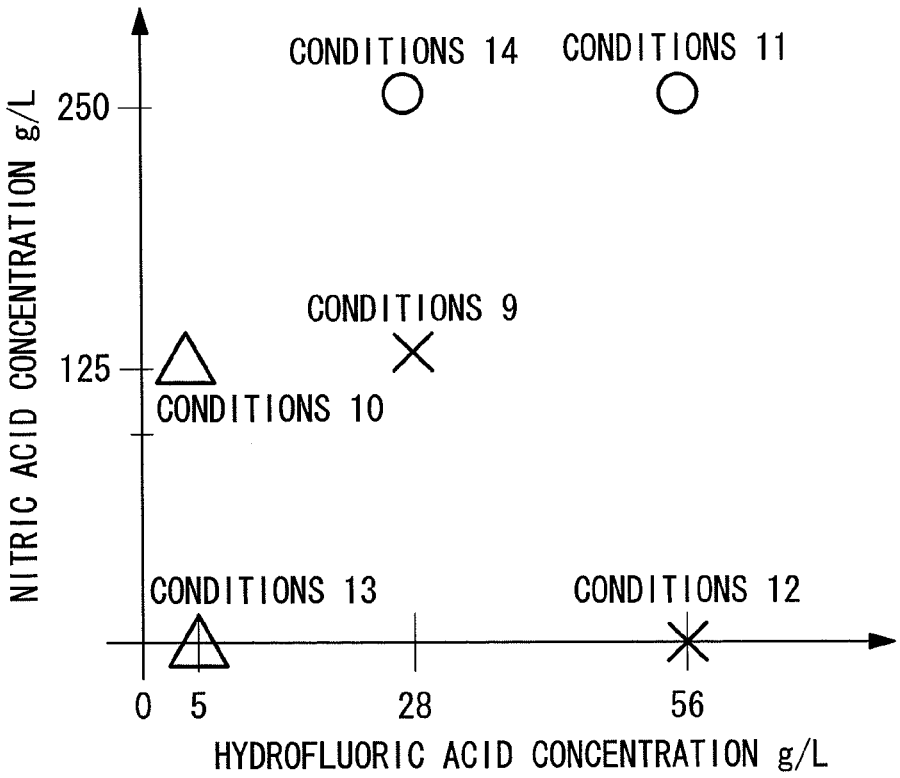
FIG. 23 A diagram illustrating the effect of the relationship between the hydrofluoric acid concentration and the nitric acid concentration on the structure following etching treatment (50° C.)

FIG. 17 to FIG. 22 are cross-sectional photographs of the test pieces following dipping for 10 minutes in each of the etchants (50° C.). FIG. 17 illustrates conditions 9, FIG. 18 illustrates conditions 10, FIG. 19 illustrates conditions 11, FIG. 20 illustrates conditions 12, FIG. 21 illustrates conditions 13, and FIG. 22 illustrates conditions 14. FIG. 23 illustrates the effect of the relationship between the hydrofluoric acid concentration and the nitric acid concentration on the structure following the etching treatment (50° C.). In the figure, test pieces in which erosion holes (pits) or fissures exceeding 10 μm were observed were recorded using the symbol x, test pieces in which localized adverse effects were observed on the base material were recorded using the symbol Δ, and test pieces in which the surface state was favorable were recorded using the symbol ○.

According to FIG. 17 to FIG. 22, erosion holes (pits) and/or fissures exceeding 10 μm were observed in the test pieces treated under the conditions 9, conditions 13 and conditions 12. On the other hand, under the conditions 10, localized adverse effects were observed on the base material. Furthermore, the surfaces of the test pieces treated under the conditions 11 and conditions 14 each exhibited a favorable state, and no erosion holes (pits) and/or fissures exceeding 10 μm were observed.

Table 3 lists the concentrations of hydrofluoric acid and nitric acid within the etchants used when the etchant temperature was 65° C., and also lists the etching rates achieved.

TABLE 3

| Conditions | Hydrofluoric acid (g/L) | Nitric acid (g/L) | Etching rate (μm/min) |
|---|---|---|---|
| 15 | 56 | 0 | 24.7 |
| 16 | 28 | 0 | 13.6 |
| 17 | 56 | 126 | 51 |
| 18 | 5.6 | 252 | 3.7 |
| 19 | 28 | 252 | 10.8 |
| 20 | 5.6 | 126 | 5.4 |

Figure 24:
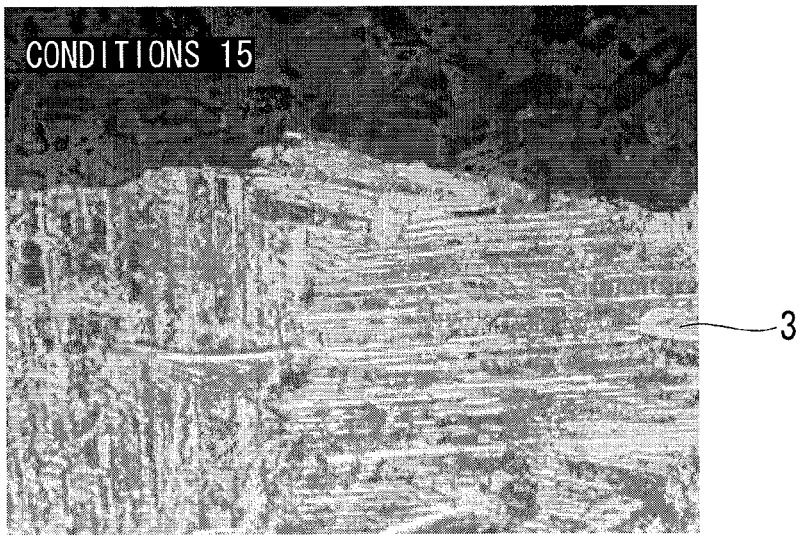
FIG. 24 A cross-sectional photograph of a test piece following dipping for 10 minutes in an etchant (65° C.) according to conditions 15.
Figure 25:
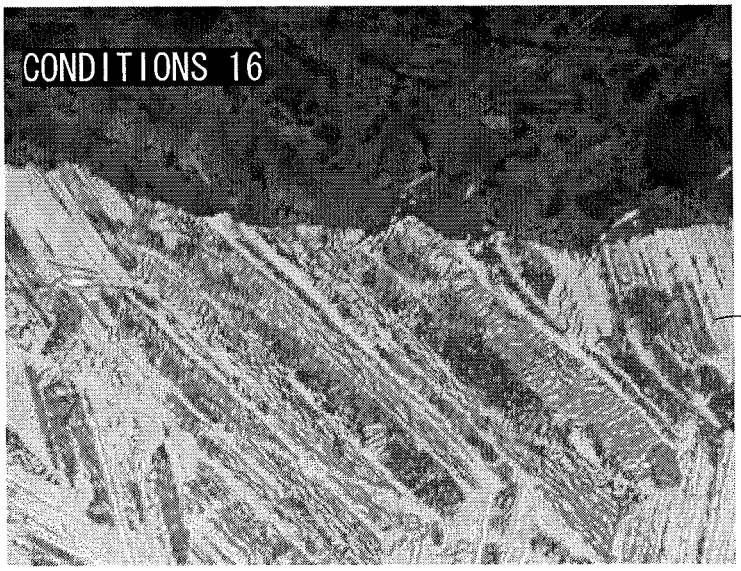
FIG. 25 A cross-sectional photograph of a test piece following dipping for 10 minutes in an etchant (65° C.) according to conditions 16.
Figure 26:
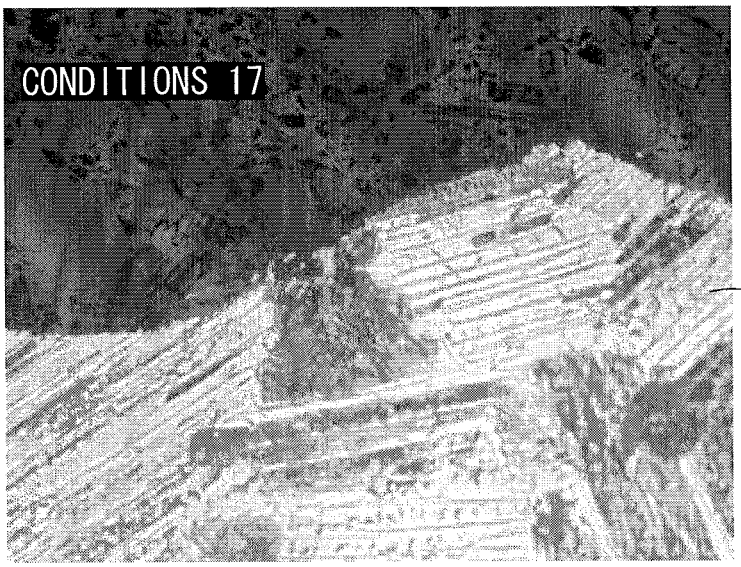
FIG. 26 A cross-sectional photograph of a test piece following dipping for 10 minutes in an etchant (65° C.) according to conditions 17.
Figure 27:
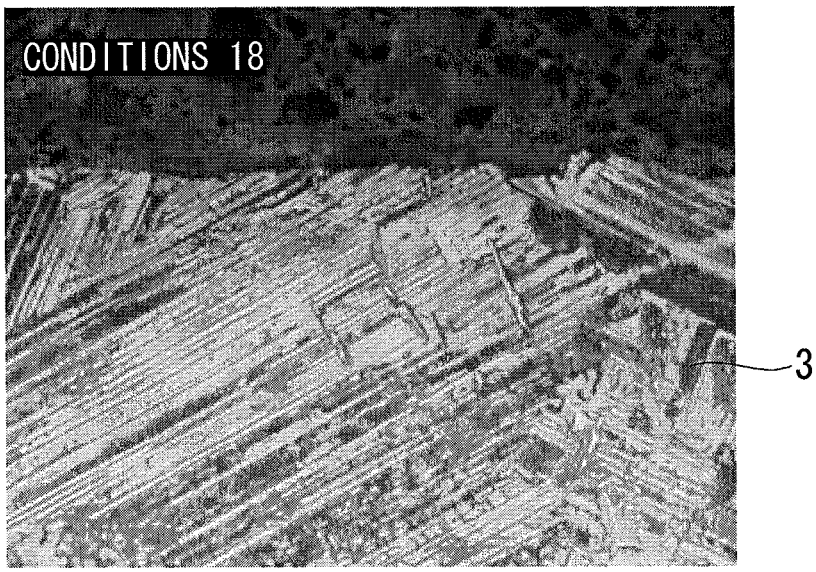
FIG. 27 A cross-sectional photograph of a test piece following dipping for 10 minutes in an etchant (65° C.) according to conditions 18.
Figure 28:
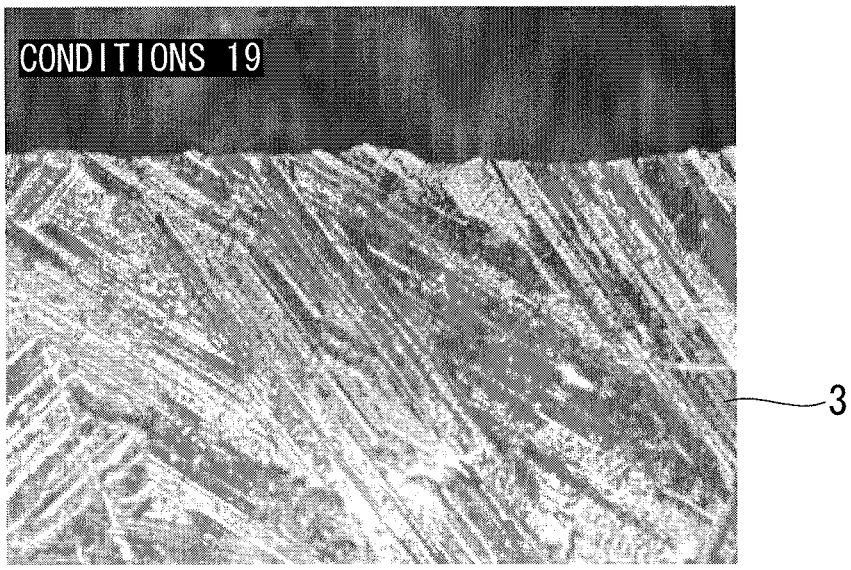
FIG. 28 A cross-sectional photograph of a test piece following dipping for 10 minutes in an etchant (65° C.) according to conditions 19.
Figure 29:
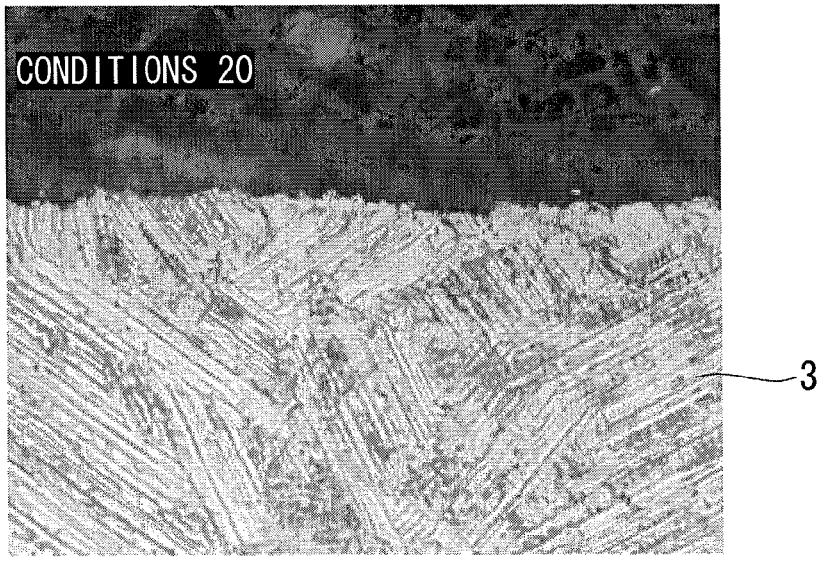
FIG. 29 A cross-sectional photograph of a test piece following dipping for 10 minutes in an etchant (65° C.) according to conditions 20.
Figure 30:
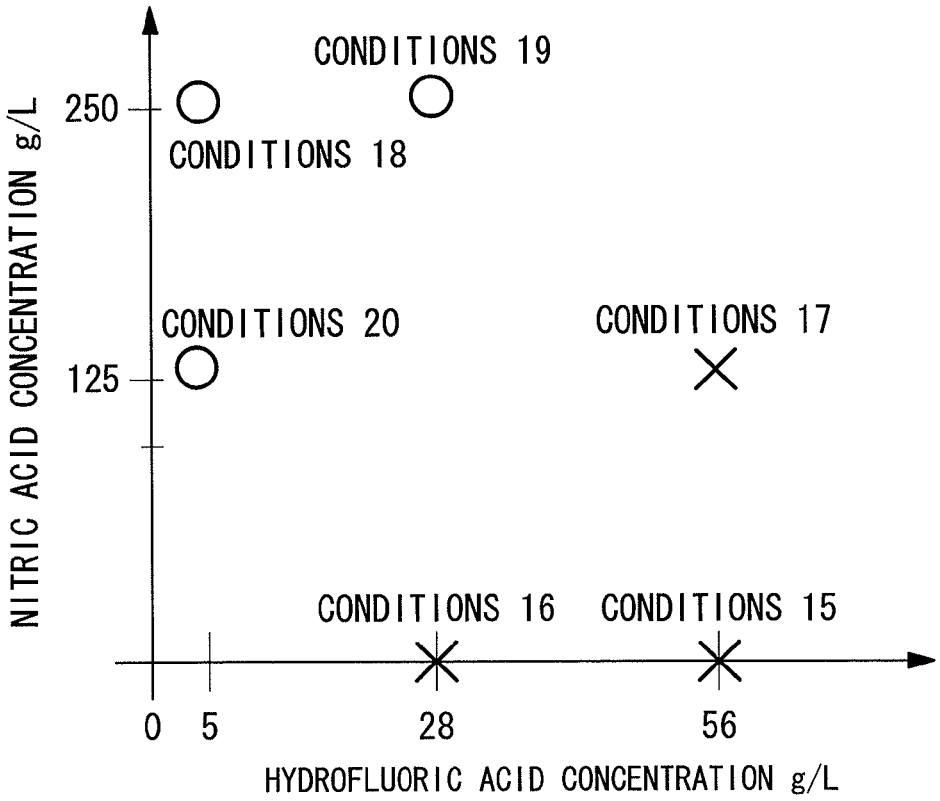
FIG. 30 A diagram illustrating the effect of the relationship between the hydrofluoric acid concentration and the nitric acid concentration on the structure following etching treatment (65° C.)

FIG. 24 to FIG. 29 are cross-sectional photographs of the test pieces following dipping for 10 minutes in each of the etchants (65° C.). FIG. 24 illustrates conditions 15, FIG. 25 illustrates conditions 16, FIG. 26 illustrates conditions 17, FIG. 27 illustrates conditions 18, FIG. 28 illustrates conditions 19, and FIG. 29 illustrates conditions 20. FIG. 30 illustrates the effect of the relationship between the hydrofluoric acid concentration and the nitric acid concentration on the structure following the etching treatment (65° C.). In the figure, test pieces in which erosion holes (pits) or fissures exceeding 10 μm were observed were recorded using the symbol x, and test pieces in which the surface state was favorable were recorded using the symbol ○.

According to FIG. 24 to FIG. 29, erosion holes (pits) and/or fissures exceeding 10 μm were observed in the test pieces treated under the conditions 15, conditions 16 and conditions 17. Furthermore, the surfaces of the test pieces treated under the conditions 18, conditions 19 and conditions 20 each exhibited a favorable state, and no erosion holes (pits) and/or fissures exceeding 10 μm were observed.

4. Addition of Phosphoric Acid to Etchant

A test piece described above was subjected to ultrasonic cleaning and a degreasing treatment (alkali cleaning), half of the test piece was then masked with an epoxy resin, and the test piece was then dipped for 90 seconds in an etchant (35° C.) having final concentrations of hydrofluoric acid 10 g/L, nitric acid 80 g/L, phosphoric acid 57 g/L and distilled water (the remainder). Following the etching treatment, the epoxy resin was removed, and the test piece was cut and inspected under an optical microscope (×200). The etching rate was calculated in the same manner as that described above in Section 3. The calculated etching rate was 1.4 μm/minute.

Further, a test piece described above was subjected to etching in the same manner as that described above without masking, and the test piece was then cut and the cross-section was inspected under an optical microscope (×500).

Figure 31:
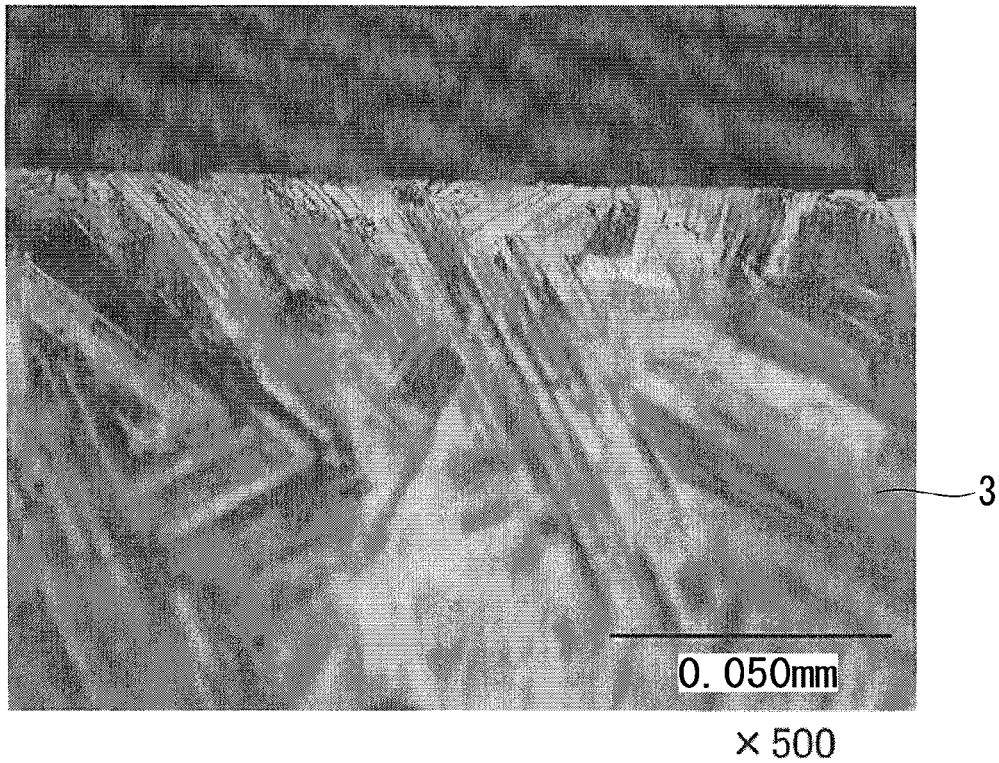
FIG. 31 A cross-sectional photograph of a test piece following dipping for 10 minutes in an etchant (35° C.) containing phosphoric acid.

FIG. 31 is a cross-sectional photograph of the test piece following dipping for 10 minutes in the etchant (35° C.) containing phosphoric acid. Based on FIG. 31 it is evident that by mixing phosphoric acid with an etchant containing hydrofluoric acid and nitric acid in a predetermined ratio, the surface of the base material following the etching treatment is able to be provided with a smoother finish.

DESCRIPTION OF REFERENCE SIGNS

1 Base material
2 Work-affected layer
3 Test piece
4 Masking material (epoxy resin)

The invention claimed is:

1. A method of removing a work-affected layer, the method comprising:

a step of dipping a TiAl-based alloy, having the work-affected layer having a thickness of 5 μm to 20 μm formed on a surface thereof by machining, in an etchant consisting of predetermined concentrations of hydrofluoric acid and nitric acid, wherein the dipping is performed under conditions in which an etching temperature is within a range of 20 to 40° C., an etching time is within a range of 10 to 30 minutes, and an etching rate is within a range of 1 to 15 μm/min, and wherein within the etchant, the concentration of the hydrofluoric acid is not less than 5 g/L and not more than 56 g/L, and the concentration of the nitric acid is selected from within a range from not less than 50 g/L to not more than 260 g/L in accordance with a combination of a concentration of the hydrofluoric acid within the etchant and an etching treatment temperature.

2. The method of removing the work-affected layer according to claim 1, wherein the TiAl-based alloy has a full lamellar structure.

* * * * *